US006185526B1

(12) United States Patent
Kato et al.

(10) Patent No.: US 6,185,526 B1
(45) Date of Patent: Feb. 6, 2001

(54) SPEECH TRANSMISSION AND RECEPTION SYSTEM FOR DIGITAL COMMUNICATION

(75) Inventors: Toshio Kato; Atsushi Shimbo, both of Tokyo (JP)

(73) Assignee: Oki Electric Industry Co., Ltd., Tokyo (JP)

( * ) Notice: Under 35 U.S.C. 154(b), the term of this patent shall be extended for 0 days.

(21) Appl. No.: 09/201,160

(22) Filed: Nov. 30, 1998

(30) Foreign Application Priority Data

Nov. 28, 1997 (JP) ..... 9-343842

(51) Int. Cl.[7] ..... G10L 19/00
(52) U.S. Cl. ..... 704/228; 704/227
(58) Field of Search ..... 704/201, 226, 704/227, 228

(56) References Cited

U.S. PATENT DOCUMENTS 5,983,174 * 11/1999 Wong et al. ..... 704/228
6,081,778 * 6/2000 Wong et al. ..... 704/227

* cited by examiner

*Primary Examiner*—Richemond Dorvil
*Assistant Examiner*—Angela Armstrong
(74) *Attorney, Agent, or Firm*—Venable; Robert J. Frank; Allen Wood

(57) ABSTRACT

A transmission device performs encoding by a speech encoding portion including a speech encoder and error correction encoder, and transmits a continuous signal without any further processing. A reception device receives the continuous signal and performs channel decoding and speech decoding as one unit by a speech decoding portion including a soft-decision error correction decoder and a soft-decision speech decoder. Thus, a transmission and reception system performs an accurate signal reproduction without removing the signal including a normal bit error rate by correcting the error by the speech decoder.

7 Claims, 7 Drawing Sheets

SPEECH TRANSMISSION AND RECEPTION SYSTEM FOR DIGITAL COMMUNICATION

BACKGROUND OF THE INVENTION

1. Field of the Invention

The present invention relates to speech transmission and reception system for digital communication of audio signals.

2. Description of the Related Art

Recently, digitalization of mobile communication systems such as mobile telephones and cordless telephone is expanding rapidly. Particularly in mobile communication systems, multiplexing techniques, high efficiency speech encoding techniques, multivalue modulation and demodulation techniques and other techniques have enabled more efficient usage of a given frequency band. At the same time, developments in speech encoding technology and speech decoding technology are anticipated from the viewpoint of improvement in communication quality.

The following is a general explanation of a conventional speech transmission and reception system for digital communication.

FIG. 7 is a block diagram of a conventional speech transmission and reception system for digital communication.

The illustrated speech transmission and reception system for digital communication comprises a microphone 11, an amplifier 12A, an A/D converter 13, a speech encoder 14, a frame making portion 15A, an error correction encoder 16, a modulator 17, a propagation path 18, a demodulator 19, an error correction decoder 20, a frame processing portion 15B, a speech decoder 21, a D/A converter 22, an amplifier 12B, and a speaker 23. From the microphone 11 to the modulator 17 constitute a transmitter, while from the demodulator 19 to the speaker 23 constitute a receiver.

First, the transmitter will be explained.

The microphone 11 is a converter that converts a speech into an electric audio signal.

The amplifier 12A is an amplifier that amplifies the audio signal.

The A/D converter 13 is a circuit that samples the audio signal at a sampling rate of 8,000 cycles per second, and converts each sample to an 8-bit digital signal. Therefore, this A/D converter sends a signal to the speech encoder 14 at a rate of 64 kilobits per second (Kbps).

The speech encoder 14 is a circuit having a function that estimates a pattern of the audio signal in advance utilizing a regularity in a state transition of the audio signal, and calculates a differential between the estimated pattern and an actual pattern of the input audio signal so as to output the differential. Thus, the input audio signal is compressed and encoded. This compressing and encoding method is called Adaptive Differential Pulse Code Modulation (ADPCM). Using the ADPCM method, the input audio signal can be compressed into a half-bit size, so a 64 Kbps input signal can be converted into a 32 Kbps signal before being sent to the frame making portion 15A.

The frame making portion 15A is a circuit having a function that generates and outputs a frame every time the 32 Kbps signal for 5 milliseconds is received. The frame making portion 15A receives 160 bits of audio signal during 5 milliseconds. Then, a cyclic redundancy check (CRC) code having 16 bits is added to the audio signal to produce a frame containing 176 bits that is sent to the error correction encoder 16. This CRC code is necessary for checking a bit error in the frame received in the receiver side. If there is a bit error or plural bit errors in a frame, the frame is removed as an error frame.

The error correction encoder 16 is a circuit that receives each frame having 176 bits sequentially and performs a convolution encoding frame by fame. The convolution encoding is an encoding process of sequential data as if the data were convoluted. In other words, each of the sequential data is coded not independently, but relatedly to the previous and the following data as if it were convoluted. By this method, even if a bit error is generated in a part of the data in the propagation path, the data can be restored at a high accuracy by utilizing the data convoluted in the previous and following data. The convolution-encoded frame can be decoded by the Viterbi decoding method. In the error detection by the CRC code in the above-mentioned error correction encoder 16, a frame in which a bit error was detected is removed. In contrast, the Viterbi decoder has a function of error detection as well as error correction. In the following explanation, a frame having 176 bits is expressed as, for example, 176 bits/frame, and a signal group encoded and arranged in series is expressed as a code sequence.

The 176 bits/frame signal is doubled in the bit size to 352 bits/frame by the convolution encoding performed by the error correction encoder 16.

The modulator 17 performs digital modulation of a carrier having a specific frequency with the output of the error correction encoder 16, so as to transmit the result to the propagation path 18, which can be a wireless or a wired path.

Next, the operation of the receiver is explained.

The demodulator 19 performs digital demodulation of the signal after propagating the propagation path 18, so as to send the result to the error correction decoder 20. In general, a digital signal is constituted with binary bits, each of which is one or zero. However, the output of this demodulator 19 is a multivalue signal in which one symbol is constituted with three bits and eight levels. One symbol means a bit of received digital signal. Therefore, the bit size of the output signal of the demodulator 19 is triple that of the input signal.

The error correction decoder 20 converts the multivalue signal having three bits and eight levels sent from the demodulator 19 into a binary signal while performing error correction by the Viterbi decoding method.

Accordingly, the bit size of the output signal of the error correction decoder 20 becomes one third of the input signal. The Viterbi decoder (not illustrated) of the error correction decoder 20 has a function of performing the error correction decoding of the signal that was processed with the convolution encoding in the transmitter side, as mentioned above.

The Viterbi decoded binary signal having 176 bits/frame is sent to the frame processing portion 15B.

The frame processing portion 15B performs error detection frame by frame using the 16 bits of CRC code in the 176 bits/frame signal. If an error is detected in a frame, the frame is removed. If no error is detected, the frame is decomposed and is converted into a 32 Kbps signal, which is sent to the speech decoder 21. This signal is the identical to the ADCPM signal encoded by the speech encoder 14 in the transmitter side.

The speech decoder 21 performs ADPCM inversion so as to decode the input signal into a 64 Kbps signal, which is sent to the D/A converter 22.

The D/A converter 22 converts the 64 Kbps digital signal into an analog signal, which is sent to the amplifier 12B.

The amplifier 12B amplifies the analog signal and sends the signal to the speaker 23.

The speaker 23 converts the analog signal into speech.

As explained above, a speech received by the microphone 11 is transmitted via the propagation path 18 and is received by the receiver to be outputted from the speaker 23.

However, the above-mentioned conventional art has the following problems to be solved.

In the system shown in FIG. 7, if an error is detected in a frame by the frame processing portion 15B, the frame is removed. When the frame that is a part of the speech signal is removed, a speech skip may occur or the quality of the speech may be deteriorated. Therefore, to prevent deterioration of the speech quality, the latest frame preceding the removed frame is inputted to the speech decoder 21 again to supplement the removed frame.

However, the above-mentioned process requires complicated control, which is disadvantageous.

SUMMARY OF THE INVENTION

An object of the present invention is to provide a speech transmission and reception system for digital communication that does not require a process for removing a signal by frame.

Another object of the present invention is to provide a speech transmission and reception system for digital communication that performs error correction with a high reliability using a multivalue signal decoded digitally.

Another object of the present invention is to provide a speech transmission and reception system for digital communication that performs signal processing utilizing a transition probability containing characteristics of the speech source so as to correct errors with high reliability.

Another object of the present invention is to provide a speech transmission and reception system for digital communication that performs communication while revising and optimizing the information for utilizing a transition probability, in accordance with an actual state.

Another object of the present invention is to provide a speech transmission and reception system for digital communication that has a function of removing dissonance noise or stopping the above-mentioned optimizing process when an error is detected in the signal by the high reliability error correction process.

A speech transmission and reception system for digital communication according to the present invention comprises an audio encoding portion for transmitting an audio signal and a speech decoding portion for receiving the audio signal. The speech encoding portion includes a speech encoder for compressing and encoding the speech signal to be transmitted and an error correction encoder for performing a convolution encoding of the compression encoded audio signal. The speech decoding portion includes a soft-decision error correction decoder for performing an error correction decoding of the received audio signal as a multivalue signal, and obtaining a soft-decision output including a probability information that represents the probability of each signal after being processed by the error correction decoding, and a soft-decision speech decoder for receiving the soft-decision output, and reproducing the most probable code sequence in accordance with the probability information and a state transition probability so as to decode the speech signal.

It is preferable that the speech decoding portion further include a memory portion for storing a transition probability table that contains state transition paths of neighboring input signal groups included in the speech signal and transition probabilities of the paths, for each characteristic of the source of the speech signal, and that the soft-decision speech decoder refers to the transition probability table in order to select the code sequence having the largest transition probability and to perform the speech decoding.

According to another aspect of the present invention, the speech decoding portion further includes a memory portion for storing a transition probability table that contains state transition paths of neighboring input signal groups included in the speech signal and transition probabilities of the paths, and a control portion for controlling the speech decoding portion by calculating a transition probability in a real input signal group from the state transition paths of the neighboring input signal groups and the transition probabilities in the transition probability table, using the soft-decision output of the soft-decision error correction decoder, keeping only the state transition path having the largest transition probability and removing other paths, and generating a survival path table so as to store the survival path table in a memory portion.

It is preferable that the speech decoding portion further include a control portion for controlling the speech decoding portion so as to attenuate the output of the speech decoding portion when an average power derived from the code sequence being processed by the soft-decision speech decoder is less than a predetermined value.

It is also preferable that the speech decoding portion further include a control portion for controlling the speech decoding portion so as to stop the operation of storing the survival path in the transition probability table.

It is also preferable that the speech decoding portion further include a control portion for controlling the speech decoding portion so as to attenuate the output of the speech decoding portion and to stop the operation of updating the survival path in use when an average power derived from the code sequence being processed by the soft-decision speech decoder is less than a predetermined value.

According to another aspect of the present invention, the speech encoding portion for transmitting a speech signal further includes a frame making portion for generating a frame from the output of the speech encoder, adding a code for detecting a bit error to a signal, and sending the signal to the error correction encoder, the speech decoding portion further includes a frame processing portion for detecting a bit error for a frame by the code for detecting a bit error, and the speech decoding portion attenuates the output of the speech decoding portion when an average power derived from the code sequence being processed by the soft-decision speech decoder is less than a predetermined value and when the frame processing portion detects a bit error of the frame.

DETAILED DESCRIPTION OF THE PREFERRED EMBODIMENTS

The present invention will be described in detail hereinafter in accordance with preferred embodiments with reference to the accompanying drawings.

First Example

Figure 1:
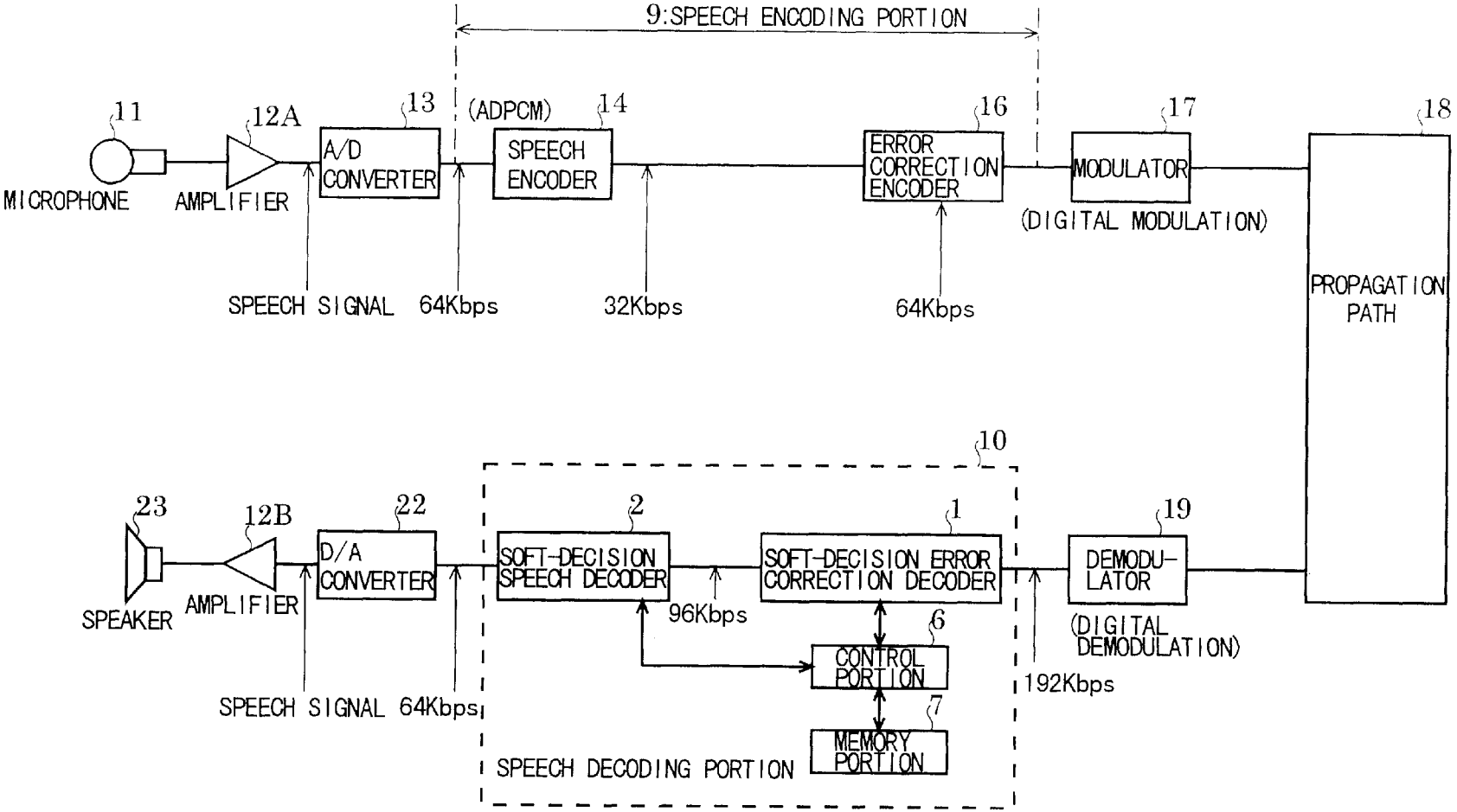
FIG. 1 is a block diagram of a speech transmission and reception system for digital communication in accordance with a first example and a second example of the present invention.

FIG. 1 shows a block diagram of a speech transmission and reception system for digital communication in accordance with a first example and a second example of the present invention.

The illustrated speech transmission and reception system for digital communication comprises a microphone 11, an amplifier 12A, an A/D converter 13, a speech encoder 14, an error correction encoder 16, a modulator 17, a propagation path 18, a demodulator 19, a speech decoding portion 10, a D/A converter 22, an amplifier 12B and a speaker 23.

Figure 7:
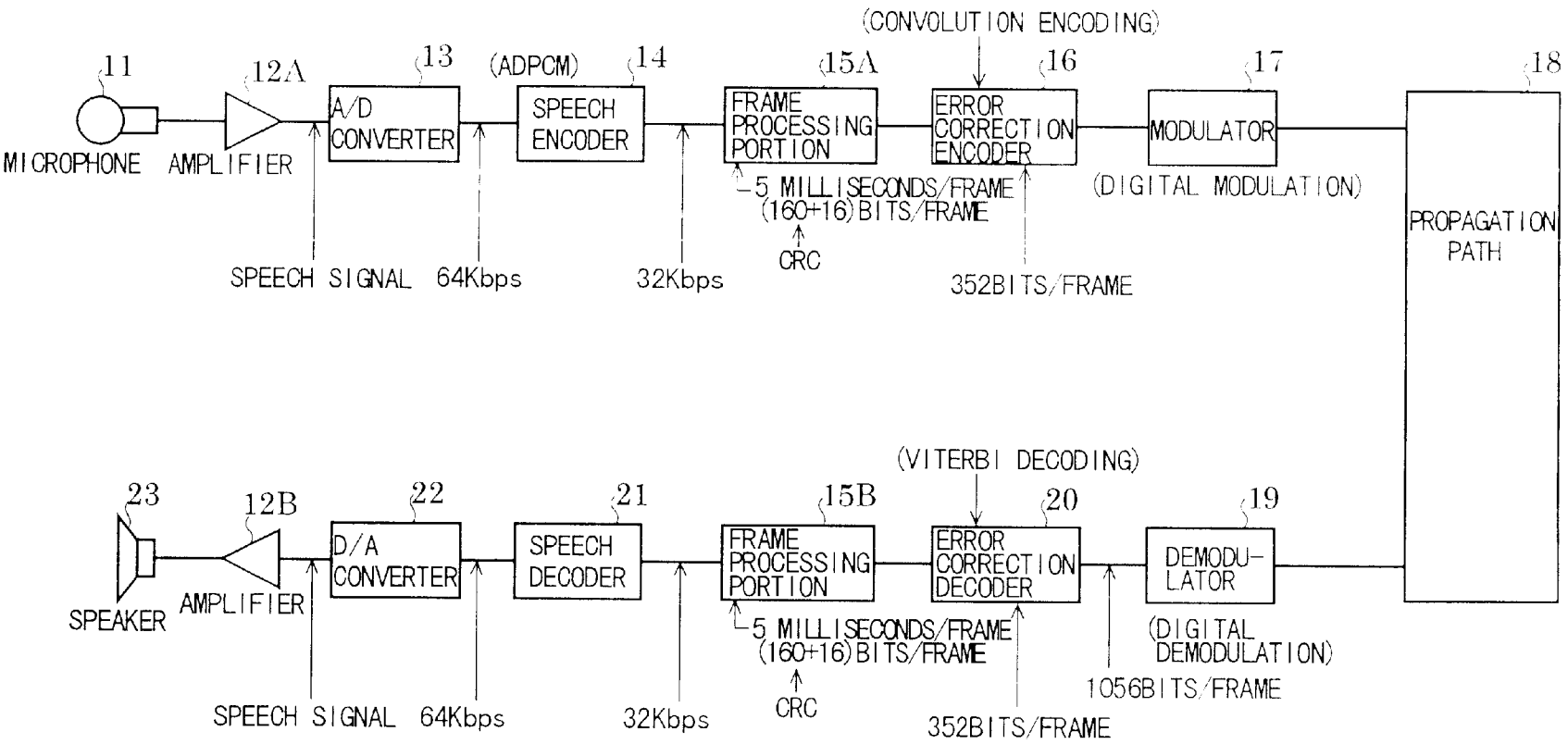
FIG. 7 is a block diagram of a speech transmission and reception system for digital communication in the prior art.

Each function of the microphone 11, the amplifier 12A, the A/D converter 13 and the speech encoder 14 is the same as of the portion with the same reference numeral of the conventional art explained with reference to FIG. 7.

The system of this example is different from the conventional art in the constitution of the speech encoding portion 9. This speech encoding portion 9 includes the speech encoder 14 and the error correction encoder 16, while the frame making portion 15A of the conventional art shown in FIG. 7 is eliminated in this example.

Though the frame making portion 15A of the conventional art adds a CRC code for error correction to the input signal, the receiver portion of this example does not perform error detection by the CRC code. Therefore, the output signal of the speech encoder 14 of the transmitter side is sent directly to the error correction encoder 16.

The error correction encoder 16 receives a signal whose bit size is compressed to a half by the speech encoder 14, and performs convolution encoding. The signal whose bit size is increased to 64 Kbps by the convolution encoding is sent to the modulator 17. The function of the error correction encoder 16 is also the same as of the portion with the same reference numeral of the prior art explained with reference to FIG. 7.

The modulator 17 performs digital modulation of a carrier having a specific frequency by the output of the error correction encoder 16, so as to transmit the result to the propagation path 18. The propagation path 18 can be either a wireless or a wired path. The demodulator 19 performs digital demodulation of the signal after passing the propagation path 18, so as to send the result to the speech decoding portion 10. The demodulator 19 outputs a multivalue signal in which one symbol is constituted with three bits and eight levels in the same way as in the conventional art explained with reference to FIG. 7. As mentioned above, one symbol corresponds to one bit of the received signal. One bit signal of a digital signal has a constant level at the transmission time. However, the level varies at random when the signal propagates in the propagation path. Therefore, the signal is digitized not into binary directly, but into a multivalue first. In the present invention, the multivalue digital signal is sent to a soft-decision speech decoder 32 so as to perform error correction with high reliability.

The following speech decoding portion 10 is an important portion in this example of the present invention.

The illustrated speech decoding portion 10 includes a soft-decision error correction decoder 1, a soft-decision speech decoder 2, a control portion 6 and a memory portion 7.

This speech decoding portion 10 performs speech decoding and channel decoding as a unit. It does not perform error detection by a CRC code. It also does not perform frame removing.

Figure 2:
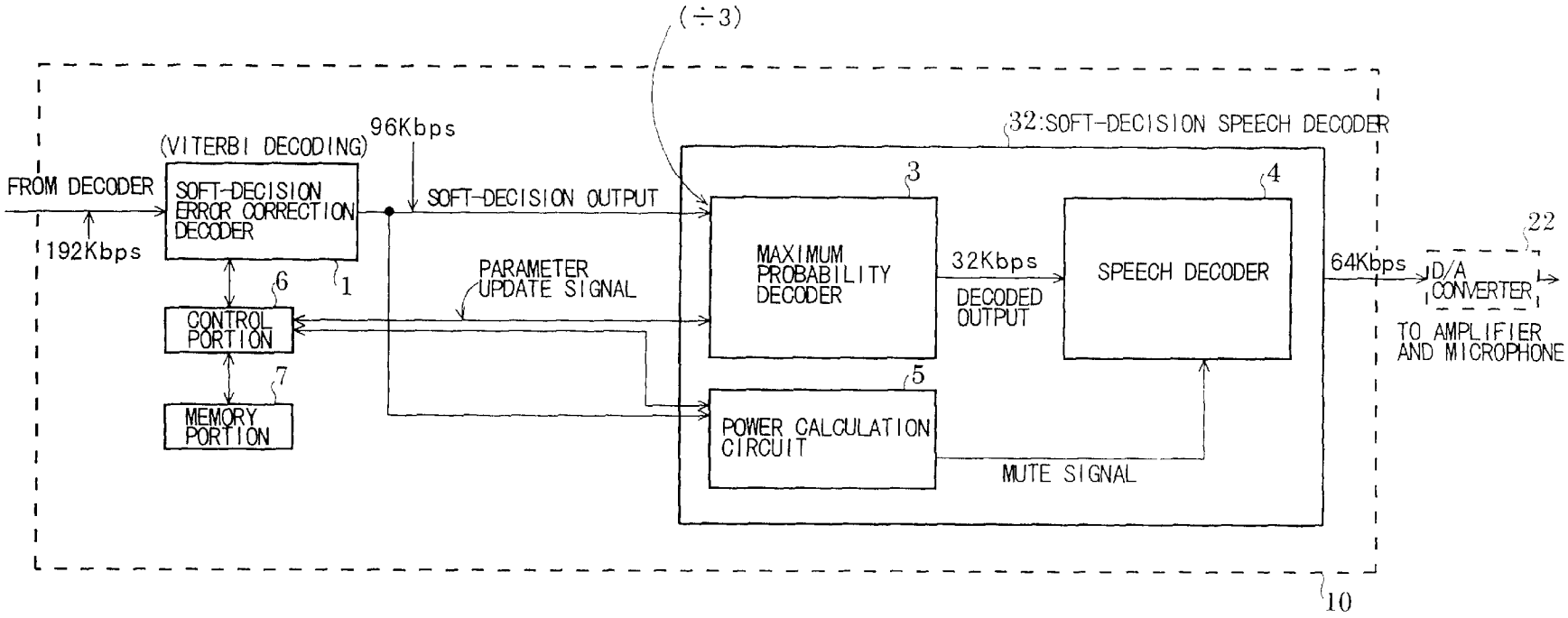
FIG. 2 is a block diagram of a speech decoding portion in accordance with a first example.

FIG. 2 is a block diagram showing the configuration of the speech decoding portion of FIG. 1 in detail.

The illustrated speech decoding portion 10 includes the soft-decision error correction decoder 1, the soft-decision speech decoder 2, the control portion 6 and the memory portion 7 as mentioned above. The soft-decision speech decoder 2 has a maximum posteriori posteriori probability decorder 3, a speech decoder 4, and a power calculation circuit 5.

The soft-decision error correction decoder 1 receives the multivalue signal having three bits and eight levels sent from the demodulator 19 (shown in FIG. 1) in a Viterbi decoder without (not shown) any processing so as to perform the error correction decoding. The Viterbi decoder is included in the soft-decision error correction decoder 1, and the function of the Viterbi decoder is the same as in the conventional art. This soft-decision error correction decoder 1 transfers a soft-decision output including the probability information that indicates the probability of each signal included in the speech signal after the Viterbi decoding, to the maximum posteriori posteriori probability decorder 3 and the power calculation circuit 5. Therefore, the 192 Kbps input signal is processed by the Viterbi decoding in the soft-decision error correction decoder 1 and is converted into the soft-decision output of 96 Kbps. In the present invention, the output signal is not digitized into a binary signal for one symbol; the signal is instead outputted as a multivalue signal. The following explanation refers to this multivalue signal as the soft-decision output including the maximum probability information.

The maximum posteriori probability decoder 3 receives the soft-decision output from the soft-decision error correction decoder 1. Then, the maximum posteriori probability decoder 3 reproduces the most probable code sequence in accordance with the maximum probability information included in the soft-decision output and the state transition probability explained below, and sends the code sequence to the speech decoder 4. The most probable code sequence is a code sequence that is the most similar to that processed in the transmitter side. Although the signal reproducing function of this maximum posteriori probability decoder 3 is explained in detail below, it is important that the maximum posteriori probability decoder 3 take the characteristics of the speech source into consideration for the signal reproducing function.

The speech decoder 4 decodes the code sequence sent from the maximum posteriori probability decoder 3 using the ADPCM inversion function. The decoded audio signal is sent to the D/A converter 22. The audio signal is converted into an analog signal and is given to the speaker 23 (see FIG. 1) in the same way as in the conventional art.

The power calculation circuit 5 receives the code sequence (i.e., the soft-decision output) from the soft-decision error correction decoder 1 and divides the code sequence by a predetermined period to calculate an average power.

The control potion 6 monitors the output of the power calculation circuit 5, and makes power calculation circuit 5 send a mute signal to the speech decoder 4 when the calculated average power is less than a predetermined value. The mute signal is a signal for suspending the operation of the speech decoder 4 so as to remove dissonance noise included in the output of the speech decoder 4. If the average power in a certain period is below the predetermined value, it is deemed that the speech is not inputted and noise may enter. Then, the muting of the output is performed as mentioned above. In addition, the control potion 6 suspends sending a parameter update signal to the maximum posteriori probability decoder 3 when the mute signal is outputted. The parameter update signal will be described in the explanation of the function of the maximum posteriori probability decoder 3. The memory portion 7 stores a parameter used by the maximum posteriori probability decoder 3.

Next, the function of the maximum posteriori probability decoder 3 is explained.

The system shown in FIG. 1 sends the audio signal via the propagation path 18. Generally, a continuous human voice as the speech signal has a certain regularity. In other words, when dividing the audio signal into parts by a predetermined period, there is some similarity between neighboring parts, and the audio signal includes numerous elements, the state of each of which varies regularly.

The regularity depends on the characteristics of the speech source such whether the speaker is a male, a female, or a child, for example. Actually, by collecting, classifying, and analyzing the speech data of plural human voices, regularities can be determined for each characteristic of the speech source. Using this result, a transition probability table is generated and is stored in the memory portion 7 shown in FIG. 2. By using this transition probability table, a speech signal that is inputted at the time T+1 can be predicted from the speech signal that was inputted at the time T, in accordance with the characteristics of the speech source. The maximum posteriori probability decoder 3 performs error correction while predicting the input signal with reference to the transition probability table.

Figure 3:
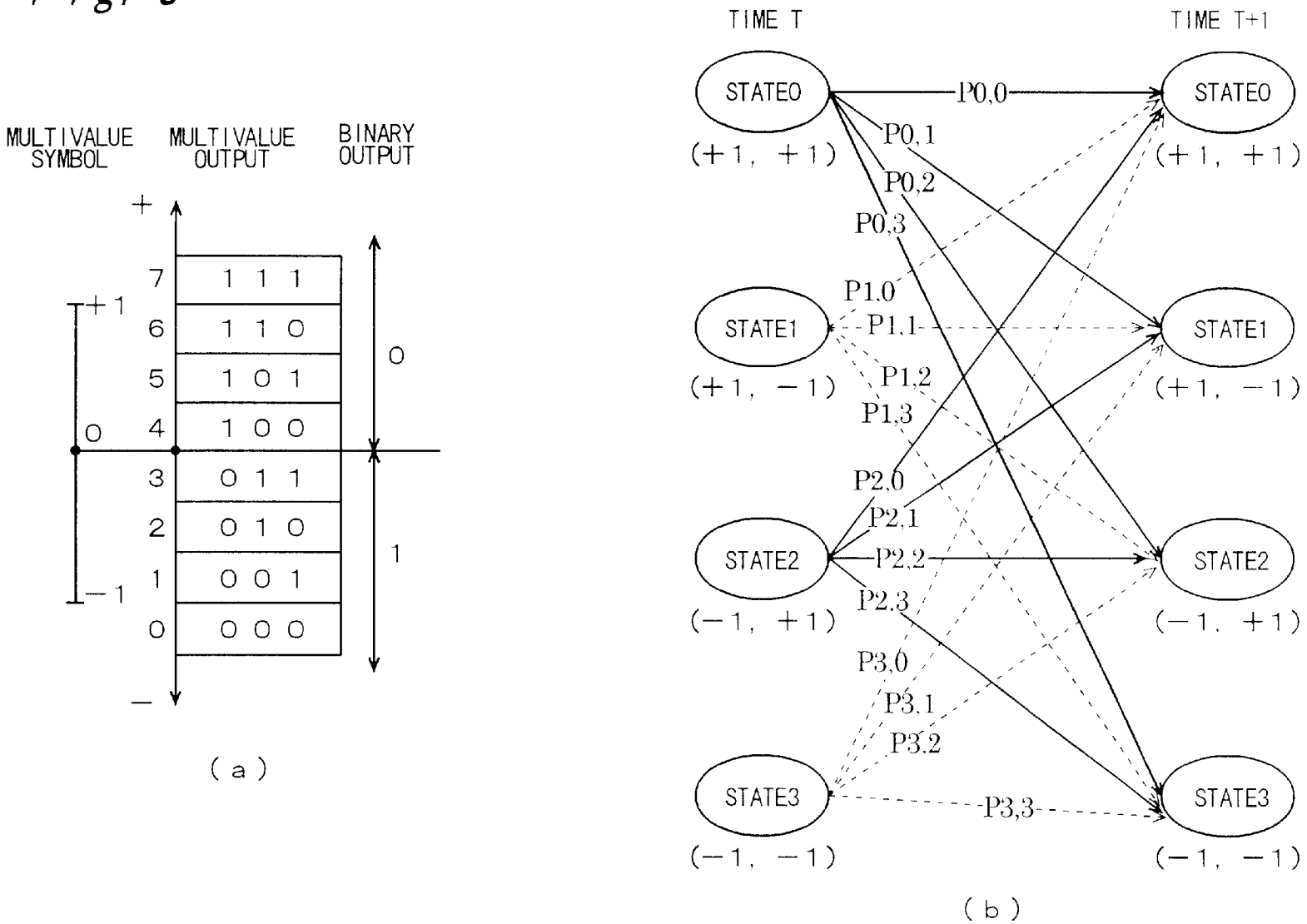
FIGS. 3A and 3B illustrate a function of a maximum probability decoder.

FIGS. 3A and 3B illustrate the function of the maximum posteriori probability decoder.

FIG. 3A shows an input signal with likelihood, and FIG. 3B shows the function of the maximum posteriori probability decoder. The maximum posteriori probability decoder 3 (see FIG. 2) converts the soft-decision output having three bits and eight levels sent from the soft-decision error correction decoder 1 into a value between −1 and +1 as shown in FIG. 3A. The soft-decision output having three bits and eight levels becomes one of eight different values from zero to seven if converted into a number as it is. In the conventional art, this value is compared with a predetermined value to generate binary data. The maximum posteriori probability decoder 3 utilizes the transition probability as explained below so as to generate binary data having a high probability from the soft-decision output. When calculating this transition probability, the value between zero and seven is converted to a value between −1 and +1 that is more convenient. For example, "000" is converted into −1, "111" is converted into +1, "001" into −0.8, and "110" into +8. Thus, so-called multivalue symbols in which one symbol is represented by a value between −1 and +1 are generated. FIG. 3A shows the multivalue soft-decision output of the soft-decision error correction decoder 1 in the middle, the multivalue symbol processed in the maximum posteriori probability decoder 3 in the left, and the binary output that the maximum posteriori probability decoder 3 finally outputs in the right, so as to clarify the relationship among them. When the multivalue symbol is processed with error correction, it is not digitized into a binary data by this relationship.

FIG. 3B shows a comparison of the states of the output signals from the maximum posteriori probability decoder 3 at the time T and the next time T+1. The expression that the state 0 is (+1, +1) at the time T means that the binary output of the value +1 and the binary output of the value +1 are outputted in this order from the maximum posteriori probability decoder 3 at the time T. Similarly, the expression that the state 0 is (+1, +1) at the time T+1 means that the binary output of the value +1 and the binary output of the value +1 are outputted in this order from the maximum posteriori probability decoder 3 at the time T+1. Each of the other parts has a similar meaning.

The state 0 at the time T can be transferred to one of state 0, state 1, state 2 and state 3 at the time T+1. There are no other state transitions considering a binary output that is a pair of binary data. The direction of the state transition is shown by a full line or a broken line with an arrow. The notes P0,1 to P3,3 on the solid line or the broken line denote the probabilities of the state transition.

For example, the note P0, 1 denotes the probability that the state 0 at the time T can transit to state 1 at the time T+1. The probabilities of the state transition P0,1 to P3,3 are obtained in advance by a computer analysis of the sample for each characteristic mentioned above. For example, a speech waveform of a male voice has different characteristics from that of a female voice. Therefore, the probability of the state transition from a state to another state is unique to the transition. The analyzed result is stored as the transition probability table in the memory portion 7 (see FIG. 2). The content of the transition probability table is such that the probabilities of the state transitions from the state 0 at the time T to plural states at the time T+1 are P0,1 to P3,3. The transition probability table, as mentioned above, contains the information of the relationships between the state transitions of the neighboring input signal groups and their transition probabilities. In the above-mentioned example, this input signal group is a pair of binary outputs. However, the input signal group can include three or four binary outputs. In this case, the variation of the transition probabilities increases.

After the speech decoding portion 10 (see FIG. 1) starts the process, the control portion 6 (see FIG. 2) updates the content of the transition probability table every predetermined period in accordance with data sampled from an actual speech signal. Thus, the transition probability is corrected in accordance with the voice of the person performing the communication so that the output of the maximum posteriori probability decoder 3 is optimized. Any transition probability table stored in the memory portion 7 can be used at first. After starting the communication, a transition probability table having the similar state transition is selected from among several kinds of transition probability tables. After that, it is preferable to control for using a transition probability table that is optimized by data sampled from the actual received speech signal. If this control is performed in a short period, the quality of the receiving speech is improved soon after starting communication. In the example explained below, the transition probability table is further improved and is converted into a survival path table so that the information stored in the memory portion is optimized while updating the content of the survival path table.

Next, a method for calculating transition probability is explained. The transition probability represents a probability that the state (S1, S2) at the time T transfers to the state (S3, S4) at the time T+1 if the two continuous symbols for obtaining the next output in the maximum posteriori probability decorder 3 are (s1, s2), including the characteristics of the speech source. The transition probability can be determined as follows. First, at the time T, a scalar product (s1×S3+s2×S4) of the two continuous symbols (s1, s2) for obtaining the next output and the output at the time T+1, i.e., the state (S1, S2), is calculated. Then the product of this scalar product and the transition probability P that the state (S1, S2) at the time T transfers to the state (S3, S4) at the time T+1 is calculated.

For example, it is supposed that the state at the time T is the state 1 that is the second state from the upper left in FIG. 3B, and two continuous symbols (+0.1, +1.0) for obtaining the next output are inputted sequentially in this order. In this case, each of the two symbols (+0.1, +1.0) is a multivalue symbol shown in FIG. 3A. After time passes from the time T to the time T+1, the transition probabilities that the state 1 at the time T transfers to each of the four different states 0–3 at the time T+1 can be expressed with P1,0, P1,1, P1,2 and P1,3 as shown in FIG. 3B.

Furthermore, the scalar products of the multivalue symbols and the states are calculated. The multivalue symbols are s1=+0.1 and s2=+1.0. The states are (S3, S4)=(+1, +1), (S3, S4)=(+1, −1), (S3, S4)=(−1, +1) and (S3, S4)=(−1, −1). The scalar product is (s1×S3+s2×S4). Therefore, the transition probabilities that the state 0 at the time T transfers to each of the states 0–3 at the time T+1 are as below.

to state 0: ((+0.1)×(+1.0)+(+1.0)×(+1.0))×P1,0=+1.1×P1,0 to state 1: ((+0.1)×(+1.0)+(+1.0)×(−1.0))×P1,1=−0.9×P1,1 to state 2: ((+0.1)×(−1.0)+(+1.0)×(+1.0))×P1,2=+0.9×P1,2 to state 3: ((+0.1)×(−1.0)+(+1.0)×(−1.0))×P1,3=−1.1×P1,3

The control portion 6 (see FIG. 2) calculates the transition probability for all of the above-mentioned state transitions every time the signal to be processed is inputted. As a result, only a state transition path having the largest transition probability survives and other paths are eliminated. This surviving state transition path is called a survival path. This survival path is calculated while considering every possible state so as to store the survival path table in the memory portion 7 (see FIG. 2). In this way the transition probability table is optimized.

For example in FIG. 3B, it is supposed that the survival path is the arrow line indicated with P0,3 among the four arrow lines showing the transition direction from the state 0 at the time T to each of the states at the time T+1. In this case, the other three arrow lines indicated with P0,0, P0,1 and P0,2 are eliminated. When the two continuous symbols for obtaining the next output are (+0.1, +1.0), the probability that the state (+1, +1) at the time T transfers to the state (−1, −1) at the time T+1 is the highest. This information is stored as the survival table in the memory portion 7.

By storing such information, the survival path is referred for (any number of) the neighboring input signal groups in order to quickly output the code sequence having the highest probability.

The maximum posteriori probability decorder 3, as explained above, receives the input signal transition with a multivalue level, refers to the survival table, and selects the code sequence to be outputted so that the state transition with the high transition probability is realized considering the speech source. In each signal for constituting the code sequence, one symbol is represented by two values. Thus, if the input signal for the speech decoding portion 10 (see FIG. 1) contains some bit errors, the most probable code sequence is outputted and the errors are corrected.

After the speech decoding portion 10 starts the operation, the control portion 6 (see FIG. 2) updates the survival path in accordance with the calculation result of the transition probability table.

Next, the general operation of the example 1 is explained with reference to FIG. 1.

Operation of Example 1

In FIG. 1, it is supposed that a male person starts to speak with the microphone 11.

The voice of the person is converted into a speech signal by the microphone 11 and is sent to the A/D converter 13 via the amplifier 12A. The speech signal is sampled by the A/D converter 13 at a sampling rate of 8,000 cycles per second, and is converted into a digital signal with 8 bits/sample. Therefore, the 64 Kbps signal is sent to the speech encoder 14. The speech encoder 14 compresses the input signal into 32 Kbps using the ADPCM method. The above-explained operation is the same as the transmission and reception system for digital communication in the conventional art (see FIG. 7).

The error correction encoder 16 performs the convolution encoding of the compressed 32 Kbps signal using the ADPCM method. After the convolution encoding, the signal becomes 64 Kbps and is sent to the modulator 17.

The modulator 17 digitally modulates a carrier having a predetermined frequency with the 64 Kbps signal and transmits the modulated signal into the propagation path 18. This signal propagates in the propagation path 18 that is a wireless or a wired path, so as to be received by the receiver side. The demodulator 19 digitally demodulates the signal received from the propagation path 18 and sends the demodulated signal to the speech decoding portion 10. The demodulator 19 outputs a multivalue signal in which one symbol is represented with three bits and eight levels.

The signal converted into 192 Kbps by the demodulator 19 is sent to the speech decoding portion 10. The soft-decision error correction decoder 1 performs the Viterbi decoding to convert the input signal into a 96 Kbps output signal, which is sent to the soft-decision speech decoder 2. This output signal is also a multivalue signal in which one symbol is represented by three bits and eight levels.

The Viterbi decoded signal, after being received by the maximum posteriori probability decorder 3 shown in FIG. 2, is converted into a multivalue symbol between −1 and +1 at first. Furthermore, the above-explained survival path table is referred to using two multivalue symbols, which are processed sequentially. In this way two output signals are selected.

The update of the survival path table is explained below in move detail. It is supposed that the memory portion 7 stores the survival path table that is generated from the transition probability table for each characteristic as explained above. This survival path table is updated at the timing when the control portion 6 outputs the parameter update signal.

During an early short period when the speech decoding portion 10 (see FIG. 2) begins operation, the control portion 6 monitors the input of the maximum posteriori probability decorder 3 and determines the category of the characteristics of the input signal (e.g., a male, a female, or a child). The category can be determined by analyzing the tendencies in the transitions of the input signal. In accordance with the determined category, the survival path table, e.g., for a male stored in the memory portion 7 is selected and is retrieved. The retrieved survival path table for a male is then given to the maximum posteriori probability decorder 3. The maximum posteriori probability decorder 3 refers to the survival path table for the operation. After that, the control potion 6 continues to monitor the input of the maximum posteriori probability decorder 3, and to calculate the transition probability in accordance with an actual input signal in every predetermined period.

From this transition probability, a new survival path table matching the actual state is generated and stored in the memory portion 7. The survival path table that is referred to by the maximum posteriori probability decorder 3 is updated regularly by the new survival path table matching the actual state.

The power calculation circuit 5 shown in FIG. 2 informs the control potion 6 when the average power derived from the soft-decision output of the soft-decision error correction decoder 1 is less than a predetermined value. Then, the control potion 6 causes the power calculation circuit 5 to output the mute signal that is given to the speech decoder 4 for removing dissonance noise outputted from the soft-decision speech decoder 2. Similar control can be performed by another way in which the power calculation circuit 5 monitors any code sequence processed by the maximum posteriori probability decorder 3.

The control potion 6 sends the mute signal to the speech decoder 4 and stops sending the parameter update signal to the maximum posteriori probability decorder 3, so as to stop updating the survival path table. The parameter update signal is a signal for instructing the regular update of the survival path table stored in the maximum posteriori probability decorder 3. The maximum posteriori probability decorder 3 stops updating the survival path table in use since the survival path derived from the low power signal that is expected not to be an audio signal should not be used for decoding.

The 32 Kbps code sequence having the highest probability that is an output of the maximum posteriori probability decorder 3 is sent to the speech decoder 4. This code sequence is encoded with the ADPCM method by the speech encoder 14 (see FIG. 1) of the transmitter side, and is compressed to a half-bit size. Therefore, the speech decoder 4 decodes the code sequence back to the 64 Kbps signal.

The D/A converter 22 converts the 64 Kbps digital signal into an analog signal and sends the signal to the amplifier 12B. The amplifier 12B (see FIG. 1) amplifies this analog signal, which is sent to the speaker 23. The speaker 23 (see FIG. 1) converts the analog signal into a speech.

Although one symbol is represented by three bits in the above-explained example, the bit size is not limited to only this example. In addition, the state transition probability of the maximum posteriori probability decorder 3 is derived in accordance with the comparison result for two symbols. However, it is possible to compare three or more state transitions.

Effects of Example 1

The above-mentioned configuration of the transmission and reception system for digital communication has the following effects.

1. A signal including a normal bit error rate can be processed with the error correction by the speech decoder without removing the frame. In addition, since the speech decoding is performed in accordance with the transition probability considered with characteristics of the speech source, the reproduced signal is more similar to the original signal.

2. Since the signal is not removed by frame, complicated control such as supplement of a frame with the preceding frame is not necessary. Thus, the load of the control portion is decreased.

Second Example

Figure 4:
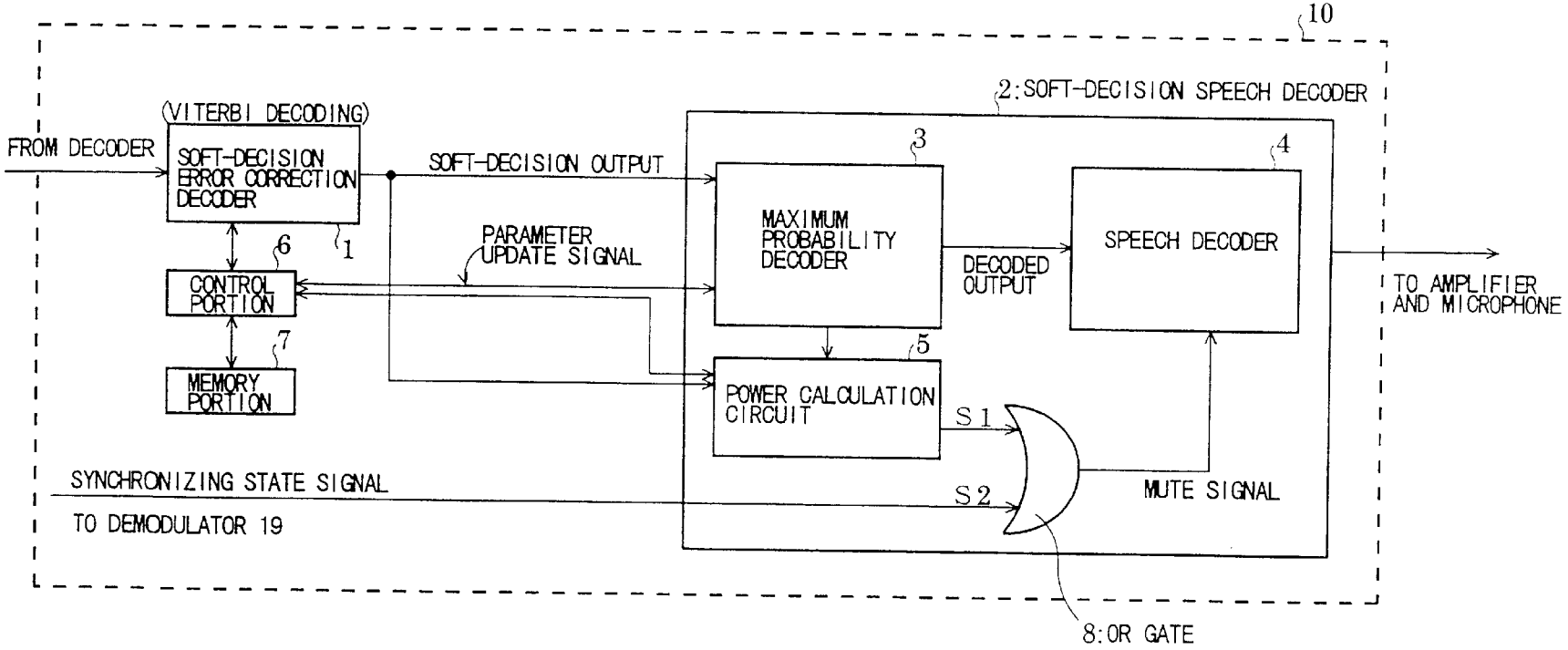
FIG. 4 is a block diagram of a speech decoding portion in accordance with a second example.

FIG. 4 is a block diagram of the speech decoding portion according to a second example of the present invention.

The configuration of this example differs from that of the first example in that the output side of the power calculation circuit 5 is provided with an OR gate 8, which has a function as a mute judge.

The OR gate 8 is a circuit for performing a logical OR operation of the output S1 of the power calculation circuit 5 and a synchronizing state signal S2, so as to obtain the mute signal that is given to the speech decoder 4.

The synchronizing state signal S2 is a signal sent from the demodulator 19 (see FIG. 1). This signal becomes valid (i.e., high level) when the demodulator 19 does not work normally.

For example, it is supposed that the speech transmission and reception system for digital communication utilizes the spectrum diffusion method. In this case, if the transmitted signal is not received synchronously in the receiver side, the received signal is almost a noise. For this situation the mute signal becomes valid so as to suspend the signal reproducing process of the speech decoder 4. Therefore, similarly to the first example, the signal reproduction by the speech decoder 4 is suspended when the average power of the received signal is low, or when the transmitted signal is not received synchronously.

Effects of Example 2

Since the OR gate is provided for obtaining the logical OR of the output of the power calculation circuit and a synchronizing state signal so as to obtain the mute signal, which is sent to the speech decoder when the demodulator does not work normally, dissonance noise can be removed.

Third Example

Figure 5:
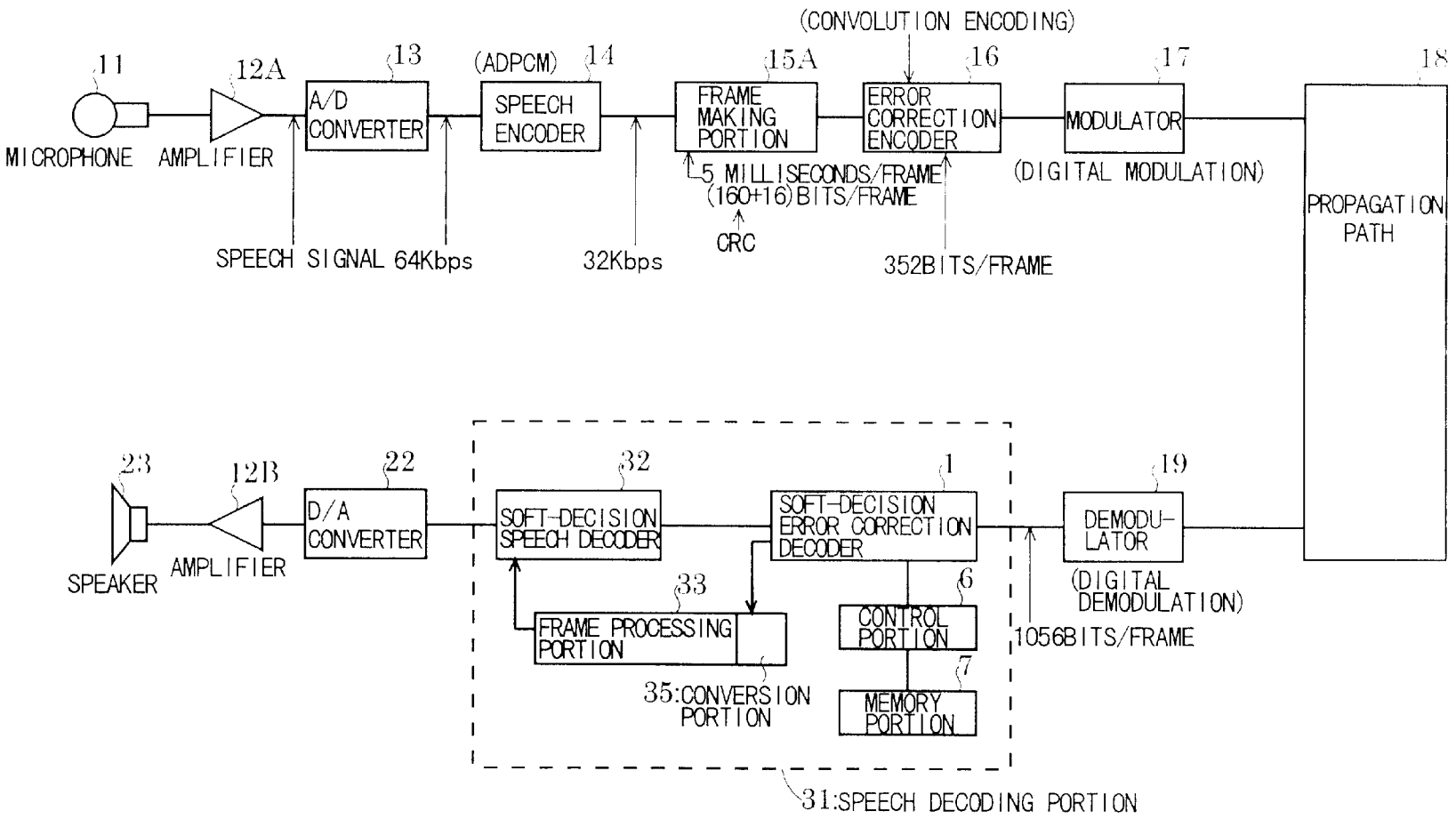
FIG. 5 is a block diagram of a speech transmission and reception system for digital communication in accordance with a third example of the present invention.

FIG. 5 shows a block diagram of a speech transmission and reception system for digital communication in accordance with a third example of the present invention.

The speech transmission and reception system for digital communication of the third example comprises a microphone 11, an amplifier 12A, an A/D converter 13, a speech encoder 14, a frame making portion 15A, an error correction encoder 16, a modulator 17, a propagation path 18, a demodulator 19, a speech decoding portion 31, a D/A converter 22, an amplifier 12B, and a speaker 23.

In this example, the frame making portion 15A is added to the speech encoding portion of the first example, and a frame processing portion 34 and a conversion portion 35 are added to the speech decoding portion 31. The transmitter side has the same configuration as in the conventional art.

As explained above, the output of the demodulator 19 is a multivalue signal in which one symbol is represented by three bits and eight levels. The bit size of the demodulator 19 is 1056 bits/frame, that is, triple the input signal. The frame includes a CRC code. This signal is also sent to the speech decoding portion 31.

Figure 6:
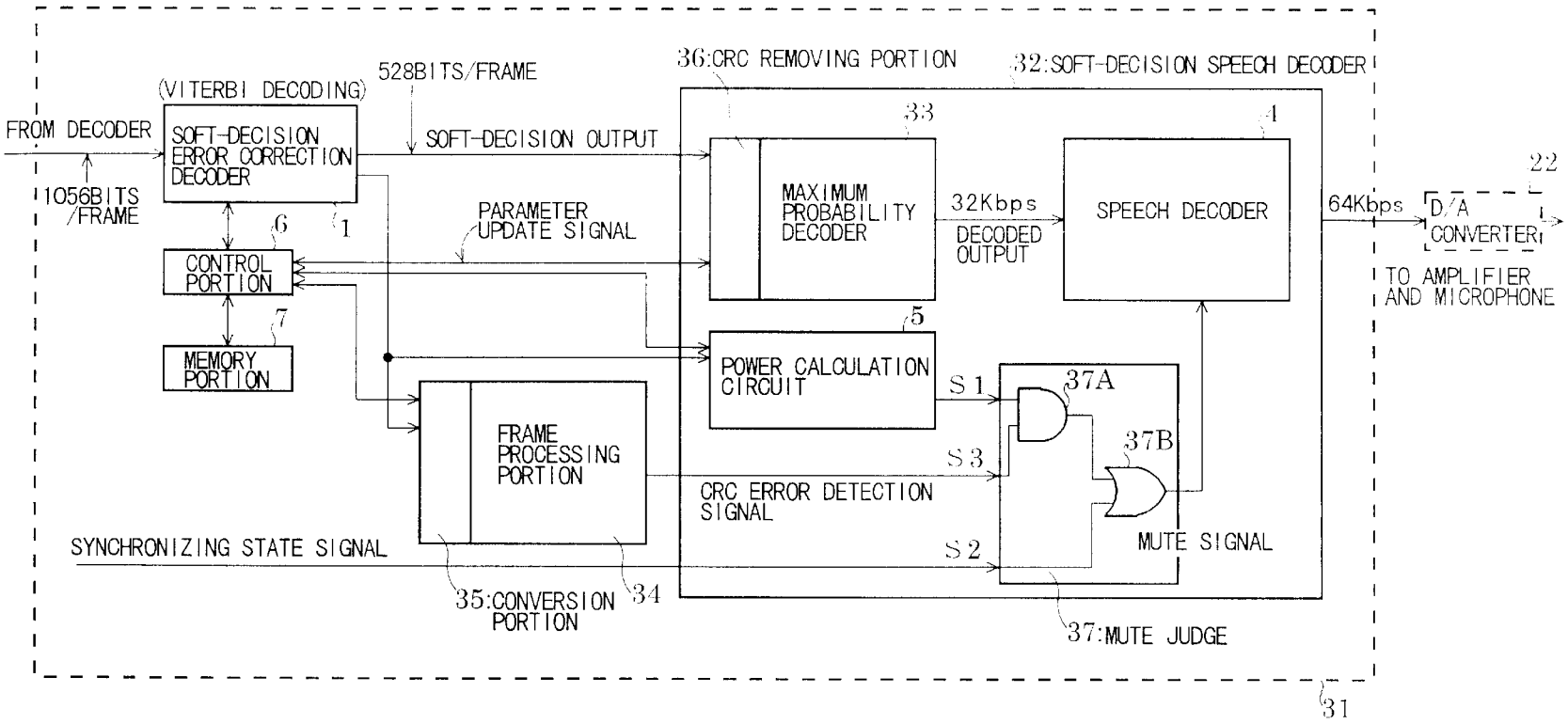
FIG. 6 is a block diagram of a speech decoding portion in accordance with a third example.

FIG. 6 is a block diagram of the speech decoding portion in the third example of the present invention.

The speech decoding portion 31 comprises a soft-decision error correction decoder 1, a soft-decision speech decoder 32, a frame processing portion 34, a control portion 6 and a memory portion 7. Furthermore, the soft-decision speech decoder 32 includes a maximum posteriori probability decorder 33, a speech decoder 4, a power calculation circuit 5 and a mute judge 37.

The soft-decision error correction decoder 1 receives the 1056 bits/frame signal sent from the demodulator 19 in the Viterbi decoder as a multivalue signal so as to perform the error correction decoding. Furthermore, a 528 bits/frame (that is outputted after compressed to a half-bit size of the input signal by the Viterbi decoding) including a probability information for each bit is inputted to the maximum posteriori probability decorder 33 and the frame processing portion 34.

The CRC removing portion 36 disposed at the input side of the maximum posteriori probability decorder 33 converts this 528 bits/frame signal into a 176 bits/frame multivalue symbol. (The bit size becomes one-third.) Then, the 16 bits for CRC are removed from this signal and the frame is decomposed. After this, the operation is similar to that of the maximum posteriori probability decorder 3 in the first or the second Example (see FIG. 2). The frame-decomposed signal becomes a 32 Kbps multivalue symbol. The maximum posteriori probability decorder 3 refers to the survival path table for every two continuous symbols of the multivalue symbol. In this way, the output signal having the highest probability is obtained, The output signal is decoded by the speech decoder in the same way as in the first example, becomes the 64 Kbps signal again, and is sent to the D/A converter 22.

On the other hand, the conversion portion 35 disposed at the input side of the frame processing portion 34 converts a 528 bits/frame signal sent from the soft-decision error correction decoder 1 into a 176 bits/frame binary signal. The frame processing portion 34 performs an error detection of a frame using the 16 bits of CRC code in this frame. If an error is detected, the CRC error detection signal S3 is sent to the mute judge 37. Furthermore, the control portion 6 stops the output of the parameter update signal so as to stop updating the survival path. In other words, the frame processing portion 34 detects a frame error, and if a frame with an error is detected, the output of the speech decoder 4 is muted. Thus, the noise is removed. Furthermore, the parameter updating by the control portion 6 is stopped, so that the survival path table is prevented from being updated unnecessarily.

The mute judge 37 receives the output S1 of the power calculation circuit, the synchronizing state signal S2 and the CRC error detection signal S3. The contents of the signals S1 and S2 are the same as explained in the second example. An AND gate 37A of the mute judge 37 receives the signals S1 and S3, and an OR gate 37B of the mute judge 37 receives the output of the AND gate 37A and the signal S2.

The mute judge 37 receives the signals S1, S2, and S3 to output the mute signal as follows.

(1) The mute signal is outputted when the output S1 of the power calculation circuit 5 and the CRC error detection signal S3 are valid. Therefore, the speech decoding process is performed if an error is not detected by the CRC code and even if the power output is low. In addition, even if an error is detected by the CRC code, the signal that is recognized as a speech signal for its power is processed by the speech decoding. Therefore in contrast to the conventional art, the signal is not removed by frame when an error is detected by the CRC code.

(2) The mute signal is outputted when the synchronizing state signal S2 is valid.

Effects of Third Example

The transmitter side, in the same way as in the conventional art, divides a 32 Kbps signal, for example, into frames, each of which has a 5 milliseconds period, and adds a CRC code to the signal so as to transmit the signal. The receiver side receives the signal, performs the process explained in the first or the second example, and performs the error detection by the CRC code.

If the operation of the speech decoder is stopped by the CRC error detection signal S3, the surviva path is prevented from being updated by the false signal. In addition, if the operation of the speech decoder is stopped by the logic AND of the output S1 of the power calculation circuit and the CRC error detection signal S3, the operation of the speech decoder is stopped only when the power output is low and an error is detected by the CRC code, resulting in proper control of the operation.

What is claimed is:

1. A speech transmission and reception system for digital communication, the system comprising:

a speech encoding portion for transmitting an audio signal, the portion including:

a speech encoder for compressing and encoding the audio signal to be transmitted, and an error correction encoder for performing a convolution encoding of the compression encoded audio signal; and a speech decoding portion for receiving the an audio signal, the portion including:

a soft-decision error correction decoder for performing an error correction decoding of the received audio signal as a multivalue signal, and obtaining a soft-decision output including a probability information that represents a probability of each signal after being processed by the error correction decoding, and a soft-decision speech decoder for receiving the soft-decision output, and reproducing the most probable code sequence in accordance with the probability information and a state transition probability, so as to decode the audio signal.

2. The speech transmission and reception system for digital communication according to claim 1, wherein the speech decoding portion further includes a memory portion for storing a transition probability table that contains state transition paths of neighboring input signal groups included in the speech signal and transition probabilities of the paths, for each characteristic of the source of the speech signal, and the soft-decision speech decoder refers to the transition probability table in order to select the code sequence having the largest transition probability and to perform the speech decoding.

3. The speech transmission and reception system for digital communication according to claim 1, wherein the speech decoding portion further includes a memory portion for storing a transition probability table that contains state transition paths of neighboring input signal groups included in the speech signal and transition probabilities of the paths, and a control portion for controlling the speech decoding portion by calculating a transition probability in a real input signal group from the state transition paths of the neighboring input signal groups and the transition probabilities in the transition probability table, using the soft-decision output of the soft-decision error correction decoder, keeping only the state transition path having the largest transition probability and removing other paths, and generating a survival path table so as to store the survival path table in the memory portion.

4. The speech transmission and reception system for digital communication according to claim 1, wherein the speech decoding portion further includes a control portion for controlling the speech decoding portion so as to attenuate the output of the speech decoding portion when an average power derived from the code sequence under being processed by the soft-decision speech decoder is less than a predetermined value.

5. The speech transmission and reception system for digital communication according to claim 3, wherein the speech decoding portion further includes a control portion for controlling the speech decoding portion so as to stop the operation of storing the survival path in the transition probability table.

6. The speech transmission and reception system for digital communication according to claim 3, wherein the speech decoding portion further includes a control portion for controlling the speech decoding portion so as to attenuate the output of the speech decoding portion and to stop the operation of updating the survival path in use when an average power derived from the code sequence under being processed by the soft-decision speech decoder is less than a predetermined value.

7. The speech transmission and reception system for digital communication according to claim 1, wherein the speech encoding portion for transmitting a speech signal further includes a frame making portion for generating a frame from the output of the speech encoder, adding a code for detecting a bit error to a signal, and sending the signal to the error correction encoder, the speech decoding portion further including a frame processing portion for detecting a bit error for a frame by the code for detecting a bit error, and the speech decoding portion attenuates the output of the speech decoding portion when an average power derived from the code sequence being processed by the soft-decision speech decoder is less than a predetermined value and when the frame processing portion detects a bit error of the frame.

* * * * *